US008035594B2

(12) United States Patent
Lee

(10) Patent No.: US 8,035,594 B2
(45) **Date of Patent: *Oct. 11, 2011**

(54) LIQUID CRYSTAL DISPLAY AND DRIVING METHOD THEREOF

(75) Inventor: Baek-Woon Lee, Yongin (KR)

(73) Assignee: Samsung Electronics Co., Ltd. (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/651,736

(22) Filed: Jan. 4, 2010

(65) Prior Publication Data

US 2010/0103158 A1 Apr. 29, 2010

Related U.S. Application Data

(60) Continuation of application No. 12/107,332, filed on Apr. 22, 2008, now Pat. No. 7,667,680, which is a continuation of application No. 11/504,194, filed on Aug. 15, 2006, now Pat. No. 7,365,724, which is a continuation of application No. 10/992,220, filed on Nov. 19, 2004, now Pat. No. 7,154,459, which is a division of application No. 09/773,603, filed on Feb. 2, 2001, now Pat. No. 6,825,824.

(30) Foreign Application Priority Data

Feb. 3, 2000 (KR) ..... 2000-5442
Jul. 27, 2000 (KR) ..... 2000-43509
Dec. 6, 2000 (KR) ..... 2000-73672

(51) Int. Cl.
*G09G 3/36* (2006.01)

(52) U.S. Cl. ..... 345/89; 345/690

(58) Field of Classification Search ..... 345/89, 345/94, 99, 690
See application file for complete search history.

(56) References Cited

U.S. PATENT DOCUMENTS 5,111,195 A 5/1992 Fukuoka et al.
5,465,102 A 11/1995 Usui et al.
5,495,265 A 2/1996 Hartman et al.
5,798,740 A 8/1998 Bitzakidis et al.
5,844,533 A 12/1998 Usui et al.
5,905,484 A 5/1999 Verhulst
6,084,561 A 7/2000 Kudo et al.
6,304,254 B1 10/2001 Johnson et al.
(Continued)

FOREIGN PATENT DOCUMENTS

EP 0487137 5/1992
(Continued)

OTHER PUBLICATIONS

European Search Report for application No. EP01102227; Completion date Jun. 28, 2001.

*Primary Examiner* — Ricardo L Osorio
(74) *Attorney, Agent, or Firm* — Cantor Colburn LLP

(57) ABSTRACT

Disclosed is an LCD and driving method thereof. The present invention comprises a data gray signal modifier for receiving gray signals from a data gray signal source, and outputting modification gray signals by consideration of gray signals of present and previous frames; a data driver for changing the modification gray signals into corresponding data voltages and outputting image signals; a gate driver for sequentially supplying scanning signals; and an LCD panel comprising a plurality of gate lines for transmitting the scanning signals; a plurality of data lines, being insulated from the gate lines and crossing them, for transmitting the image signals; and a plurality of pixels, formed by an area surrounded by the gate lines and data lines and arranged as a matrix pattern, having switching elements connected to the gate lines and data lines.

18 Claims, 16 Drawing Sheets

U.S. PATENT DOCUMENTS

| | | | |
|---|---|---|---|
| 6,538,630 | B1 | 3/2003 | Tanaka et al. |
| 6,707,439 | B2 | 3/2004 | Ijima et al. |
| 6,825,824 | B2 | 11/2004 | Lee |
| 7,154,459 | B2 | 12/2006 | Lee |
| 7,365,724 | B2 | 4/2008 | Lee |

FOREIGN PATENT DOCUMENTS

| | | |
|---|---|---|
| EP | 0750288 | 12/1996 |
| EP | 0911795 A2 | 4/1999 |
| JP | 04-268599 | 9/1992 |
| JP | 04288589 | 10/1992 |
| JP | 10-039837 | 2/1998 |
| JP | 11052906 | 2/1999 |
| JP | 2001201732 | 7/2001 |
| KR | 10998066488 | 10/1998 |
| KR | 19990078257 | 10/1999 |
| KR | 1019980085824 | 12/1999 |
| TW | 85113451 | 10/2000 |
| WO | 9616393 | 5/1996 |

Fig.10

| Gn' | | Gn | | | | | | | |
|---|---|---|---|---|---|---|---|---|---|
| | | 0 | 1 | 2 | 2 | ... | 253 | 254 | 255 |
| Gn−1 | 0 | 0 | 1 | 3 | 5 | ... | 255 | 255 | 255 |
| | 1 | 0 | 1 | 3 | 4 | ... | 255 | 255 | 255 |
| | 2 | 0 | 1 | 2 | 3 | ... | 255 | 255 | 255 |
| | 3 | 0 | 0 | 2 | 3 | ... | 255 | 255 | 255 |
| | ⋮ | ⋮ | ⋮ | ⋮ | ⋮ | ⋮ | ⋮ | ⋮ | ⋮ |
| | 253 | 0 | 0 | 0 | 0 | ... | 253 | 254 | 255 |
| | 254 | 0 | 0 | 0 | 0 | ... | 253 | 254 | 255 |
| | 255 | 0 | 0 | 0 | 0 | ... | 252 | 253 | 255 |

LIQUID CRYSTAL DISPLAY AND DRIVING METHOD THEREOF

CROSS REFERENCE TO PRIOR APPLICATIONS

This application is a Continuation Application of co-pending U.S. patent application Ser. No. 12/107,332, filed Apr. 22, 2008, which is Continuation Application of U.S. patent application Ser. No. 11/504,194, filed Aug. 15, 2006, which is Continuation Application of co-pending U.S. patent application Ser. No. 10/992,220, filed Nov. 19, 2004, which is a Divisional Application from U.S. patent application Ser. No. 09/773,603, filed Feb. 2, 2001, which claims priority to and the benefit of Korean Patent Application Nos. 2000-5442, filed on Feb. 3, 2000; 2000-43509, filed on Jul. 27, 2000; and 2000-73672, filed on Dec. 6, 2000, which are all hereby incorporated by reference for all purposes as if fully set forth herein.

BACKGROUND OF THE INVENTION (a) Field of the Invention

The present invention relates to a Liquid Crystal Display (LCD) and driving method thereof. More specifically, the present invention relates to an LCD and driving method for providing compensated data voltage in order to improve a response speed of the liquid crystal.

(b) Description of the Related Art

As personal computers (PC) and televisions have recently become lighter in weight and slimmer in thickness, display devices have also been required to become lighter and slimmer. Accordingly, flat panel type displays such as the LCD instead of cathode ray tubes (CRT) have been developed.

In the LCD, an electric field is supplied to liquid crystal material having anisotropic permittivity and is injected between two substrates, and the quantity of light projected on the substrates is controlled by the intensity of the electric field, thereby obtaining desired image signals. Such an LCD is one of the most commonly used portable flat panel display devices, and in particular, the thin film transistor liquid crystal display (TFT-LCD) employing the TFT as a switching element is widely utilized.

As the TFT-LCDs have been increasingly used as display devices of computers and televisions, the need for implementing moving pictures has increased. However, since the conventional TFT-LCDs have a delayed response speed, it is difficult to implement moving pictures using the conventional TFT-LCD. To solve the problem of the delayed response speed, another type of TFT-LCD that uses the optically compensated band (OCB) mode or ferro-electric liquid crystal (FLC) has been developed.

However, the structure of the conventional TFT-LCD panel must be modified to use the OCB mode or the FLC.

SUMMARY OF THE INVENTION

It is an object of the present invention to enhance the response speed of the liquid crystal by modifying the liquid crystal driving method without modifying the structure of the TFT-LCD.

In one aspect of the present invention, an LCD comprises: a data gray signal modifier for receiving gray signals from a data gray signal source, and outputting modification gray signals by consideration of gray signals of present and previous frames; a data driver for changing the modification gray signals into corresponding data voltages and outputting image signals; a gate driver for sequentially supplying scanning signals; and an LCD panel comprising a plurality of gate lines for transmitting the scanning signals; a plurality of data lines, being insulated from the gate lines and crossing them, for transmitting the image signals; and a plurality of pixels, formed by an area surrounded by the gate lines and data lines and arranged as a matrix pattern, having switching elements connected to the gate lines and data lines.

The data gray signal modifier comprises: a frame storage device for receiving the gray signals from the data gray signal source, storing the gray signals during a single frame, and outputting the same; a controller for controlling writing and reading the gray signals of the frame storage device; and a data gray signal converter for considering the gray signals of a present frame transmitted by the data gray signal source and the gray signals of a previous frame transmitted by the frame storage device, and outputting the modification gray signals.

The LCD further comprises: a combiner for receiving the gray signals from the data gray signal source, combining the gray signals to be synchronized with the clock signal frequency with which the controller is synchronized, and outputting the combined gray signals to the frame storage device and the data gray signal converter; and a divider for dividing the gray signals output by the data gray signal converter so as to be synchronized with the frequency with which the gray signals transmitted by the data gray signal source are synchronized.

In another aspect of the present invention, in an LCD driving method comprising a plurality of gate lines; a plurality of data lines being insulated from the gate lines and crossing them; and a plurality of pixels, formed by an area surrounded by the gate lines and data lines and arranged as a matrix pattern, having switching elements connected to the gate lines and data lines, an LCD driving method comprises: (a) sequentially supplying scanning signals to the gate lines; (b) receiving image signals from a image signal source, and generating modification image signals by considering image signals of present and previous frames; and (c) supplying data voltages corresponding to the generated modification image signals to the data lines.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 10 shows a conversion table according to the first preferred embodiment of the present invention;

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

The LCD comprises a plurality of gate lines which transmit scanning signals, a plurality of data lines which cross the gate lines and transmit image data, and a plurality of pixels which are formed by regions defined by the gate lines and data lines, and are interconnected through the gate lines, data lines, and switching elements.

Figure 1:
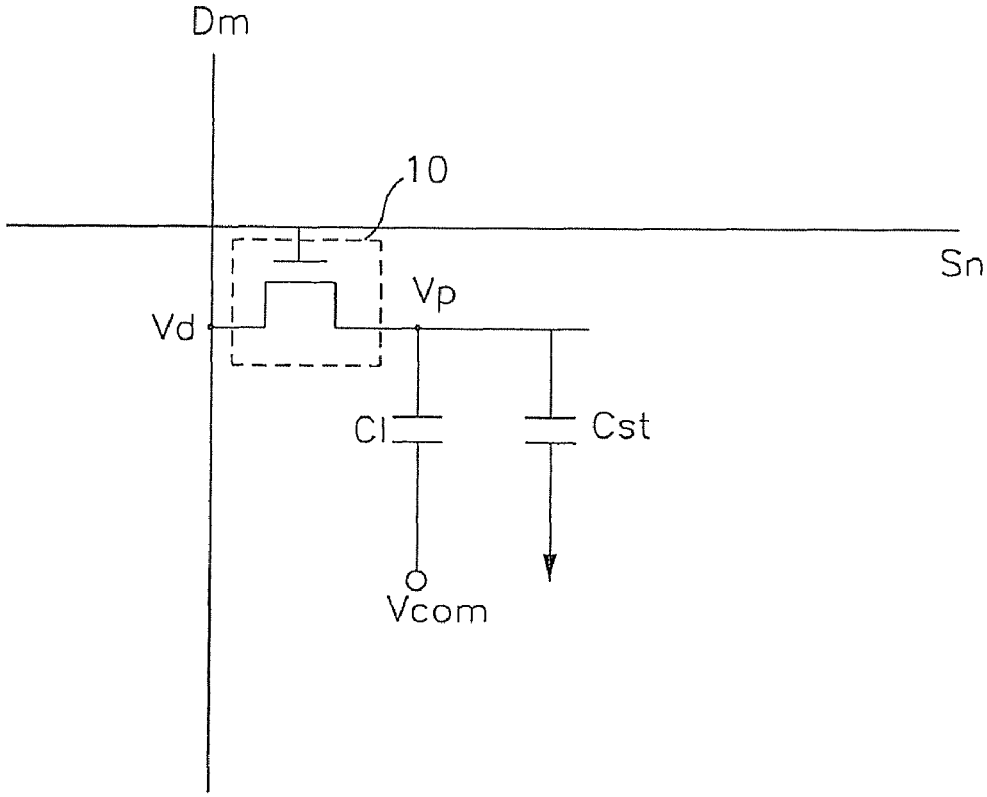
FIG. 1 shows an equivalence circuit of an LCD pixel.

Each pixel of the LCD can be modeled as a capacitor having the liquid crystal as a dielectric substance, that is, a liquid crystal capacitor, and FIG. 1 shows an equivalence circuit of the pixel of the LCD.

As shown, the LCD pixel comprises a TFT 10 having a source electrode connected to a data line $D_m$ and a gate electrode connected to a gate line $S_n$, a liquid crystal capacitor $C_1$ connected between a drain electrode of the TFT 10 and a common voltage $V_{com}$, and a storage capacitor $C_{st}$ connected to the drain electrode of the TFT 10.

When a gate ON signal is supplied to the gate line Sn to turn on the TFT 10, the data voltage $V_d$ supplied to the data line is supplied to each pixel electrode (not illustrated) via the TFT 10. Then, an electric field corresponding to a difference between the pixel voltage Vp supplied to the pixel electrode and the common voltage $V_{com}$ is supplied to the liquid crystal (shown as the liquid crystal capacitor in FIG. 1) so that the light permeates the TFT with a transmission corresponding to a strength of the electric field. At this time, the pixel voltage $V_p$ is maintained during one frame period. The storage capacitor $C_{st}$ is used in an auxiliary manner so as to maintain the pixel voltage $V_p$ supplied to the pixel electrode.

Since the liquid crystal has anisotropic permittivity, the permittivity depends on the directions of the liquid crystal. That is, when a direction of the liquid crystal is changed as the voltage is supplied to the liquid crystal, the permittivity is also changed, and accordingly, the capacitance of the liquid crystal capacitor (which will be referred to as the liquid crystal capacitance) is also changed. After the liquid crystal capacitor is charged while the TFT is turned ON, the TFT is then turned OFF. If the liquid crystal capacitance is changed, the pixel voltage $V_p$ at the liquid crystal is also changed, since Q=CV.

For an example of normally white mode twisted nematics (TN) LCD, when zero voltage is supplied to the pixel, the liquid crystal capacitance C(0V) becomes $\in_{\perp}A/d$, where $\in_{\perp}$ represents the permittivity when the liquid crystal molecules are arranged in the direction parallel with the LCD substrate, that is, when the liquid crystal molecules are arranged in the direction perpendicular with that of the light, 'A' represents the area of the LCD substrate, and 'd' represents the distance between the substrates. If the voltage for implementing a full black is set to be 5V, when the 5V voltage is supplied to the liquid crystal, the liquid crystal is arranged in the direction perpendicular to the substrate, and therefore, the liquid crystal capacitance C(5V) becomes $\in_{//}A/d$. Since $\in_{//}-\in_{\perp}>0$ in the case of the liquid crystal used in the TN mode, the more the pixel voltage supplied to the liquid crystal becomes greater, the more the liquid crystal capacitance becomes greater.

The amount the TFT must charge so as to make the n-th frame full black is C(5V)×5V. However, if it is assumed that the (n−1)th frame is full white ($V_{n-1}$=0V), the liquid crystal capacitance becomes C(0V) since the liquid crystal has not yet responded during the TFT's turn ON period. Hence, even when the n-th frame supplies 5V data voltage Vd to the pixel, the actual amount of the charge provided to the pixel becomes C(0V)×5V, and since C(0V)<C(5V), the pixel voltage below 5V (e.g., 3.5V) is actually supplied to the liquid crystal, and the full black is not implemented. Further, when the (n+1)th frame supplies 5V data voltage $V_d$ so as to implement the full black, the amount of the charge provided to the liquid crystal becomes C(3.5V)×5V, and accordingly, the voltage $V_p$ supplied to the liquid crystal ranges between 3.5V and 5V. After repeating the above-noted process, the pixel voltage $V_p$ reaches a desired voltage after a few frames.

The above-noted description will now be described with respect to gray levels. When a signal (a pixel voltage) supplied to a pixel is changed from a lower gray to a higher gray (or from a higher gray to a lower gray), the gray of the present frame reaches the desired gray after a few frames since the gray of the present frame is affected by the gray of a previous frame. In a similar manner, the permittivity of the pixel of the present frame reaches a desired value after a few frames since the permittivity of the pixel of the present frame is affected by that of the pixels of the previous frame.

If the (n−1)th frame is full black, that is, the pixel voltage $V_p$ is 5V, and the n-th frame supplies 5V data voltage so as to implement the full black, the amount of the charge corresponding to C(5V)×5V is charged to the pixel since the liquid crystal capacitance is C(5V), and accordingly, the pixel voltage $V_p$ of the liquid crystal becomes 5V.

Therefore, the pixel voltage $V_p$ actually supplied to the liquid crystal is determined by the data voltage supplied to the present frame as well as the pixel voltage $V_p$ of the previous frame.

Figure 2:
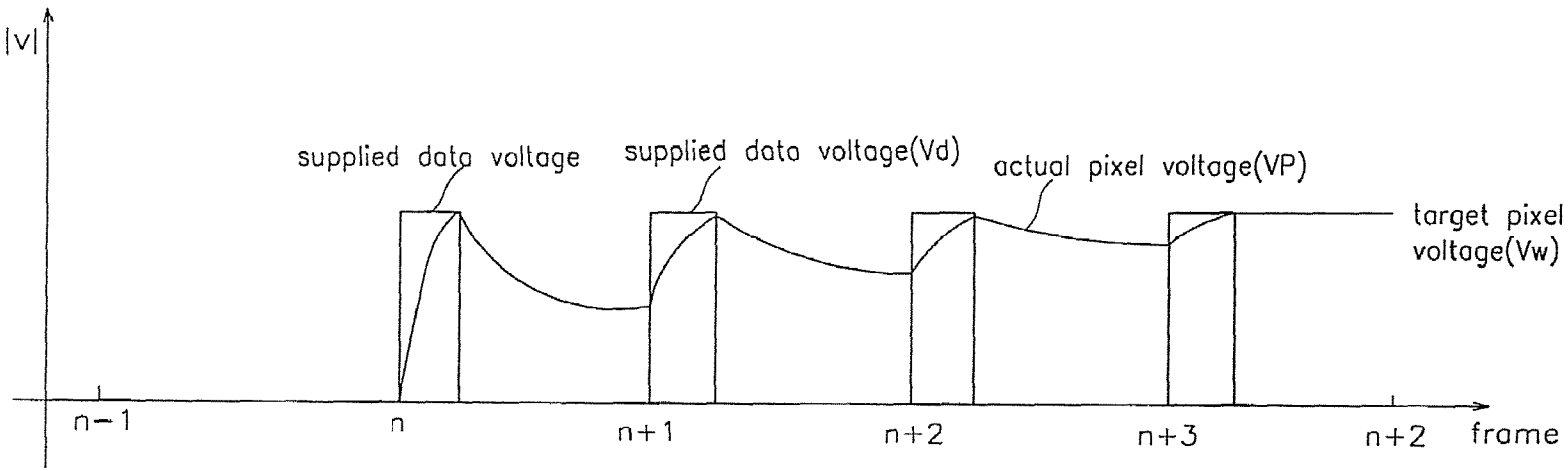
FIG. 2 shows data voltages and pixel voltages supplied by a prior driving method.

FIG. 2 shows the data voltages and pixel voltages supplied by a prior driving method.

As shown, the data voltage $V_d$ corresponding to a target pixel voltage $V_w$ is conventionally supplied for each frame without regarding the pixel voltage $V_p$ of the previous frame. Hence, the actual pixel voltage $V_p$ supplied to the liquid crystal becomes lower or higher than the target pixel voltage by the liquid crystal capacitance corresponding to the pixel voltage of the previous frame, as described above. Hence, the pixel voltage $V_p$ reaches the target pixel voltage after a few frames.

Figure 3:
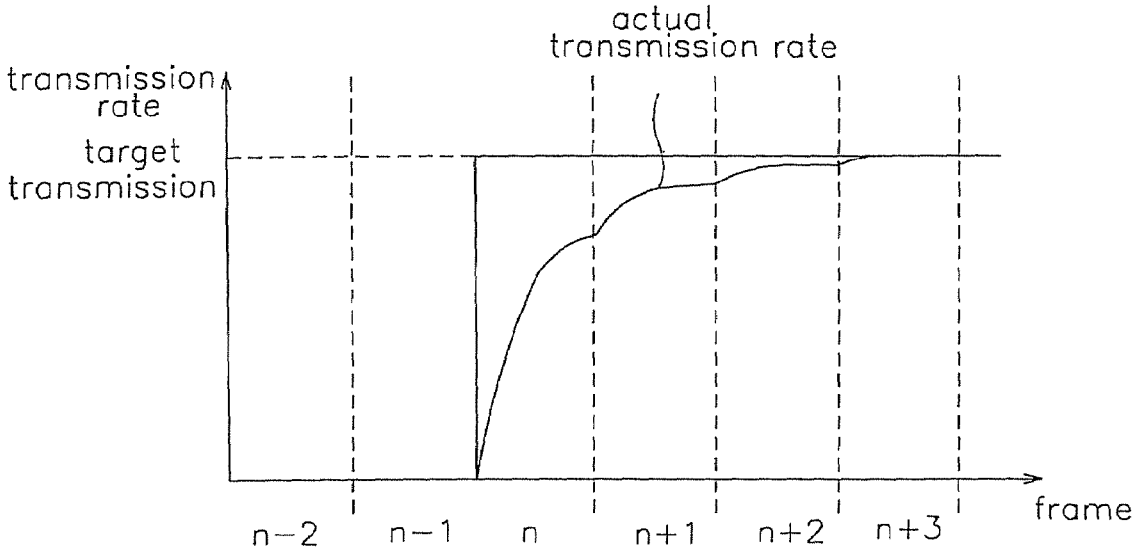
FIG. 3 shows a transmission of the LCD according to a prior driving method.

FIG. 3 shows a transmission of the LCD according to a prior driving method.

As shown, since the actual pixel voltage becomes lower than the target pixel voltage, the permittivity reaches the target permittivity after a few frames even when the response time of the liquid crystal is within one frame.

In the preferred embodiment of the present invention, a picture signal $S_n$ of the present frame is compared with a picture signal $S_{n-1}$ of a previous frame so as to generate a modification signal $S_n'$ and the modified picture signal $S_n'$ is supplied to each pixel. Here, the picture signal $S_n$ represents the data voltage in the case of analog driving methods. However, since binary gray codes are used to control the data voltage in digital driving methods, the actual modification of the voltage supplied to the pixel is performed by the modification of the gray signal.

First, if the picture signal (the gray signal or data voltage) of the present frame is identical with the picture signal of the previous frame, the modification is not performed.

Second, if the gray signal (or the data voltage) of the present frame is higher than that of the previous frame, a modified gray signal (data voltage) higher than the present gray signal (data voltage) is output, and if the gray signal (or the data voltage) of the present frame is lower than that of the previous frame, a modified gray signal (data voltage) lower than the present gray signal (data voltage) is output. At this time, the modification degree is proportional to the difference between the present gray signal (data voltage) and the gray signal (data voltage) of the previous frame.

A method for modifying the data voltage according to a preferred embodiment will now be described.

Figure 4:
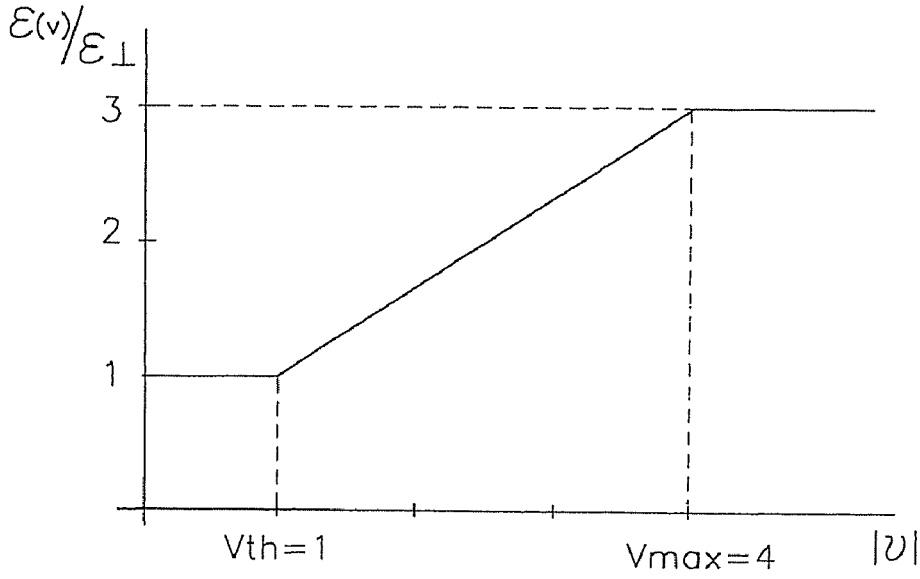
FIG. 4 shows a modeled relation between the voltage and permittivity of the LCD.

FIG. 4 shows a modeled relation between the voltage and permittivity of the LCD.

As shown, the horizontal axis represents the pixel voltage, and the perpendicular axis represents a ratio between the permittivity $\in(v)$ at a predetermined pixel voltage v and the permittivity $\in_\perp$ at the time the liquid crystal is arranged parallel to the substrate, that is, when the liquid crystal is perpendicular to the permeating direction of the light.

The maximum value of $\in(v)/\in_\perp$, that is, $\in_{//}/\in_\perp$ is assumed to be 3, $V_{th}$ to be 1V, and $V_{max}$ to be 4V. Here, the $V_{th}$ and $V_{max}$ respectively represent the pixel voltages of the full white and full black (or vice versa).

When the capacitance of the storage capacitor (which will be referred to as the storage capacitance) is set to be identical with an average value $<C_{st}>$ of the liquid crystal capacitance, and the area of the LCD substrate and distance between the substrates are respectively set to be 'A' and 'd', the storage capacitance $C_{st}$ can be expressed as Equation 1.

$$C_{st}=<C_l>=(1/3)\cdot(\in_{//}+2\in_\perp)\cdot(A/d)=(5/3)\cdot(\in_\perp\cdot A/d)=(5/3)\cdot C0 \quad \text{Equation 1}$$

where $C0=\in_\perp\cdot A/d$.

Referring to FIG. 4, $\in(v)/\in_\perp$ can be expressed as Equation 2.

$$\in(v)/\in_\perp=(1/3)\cdot(2V+1) \quad \text{Equation 2}$$

Since total capacitance C(V) of the LCD is the sum of the liquid crystal and the storage capacitance, the capacitance C(V) can be expressed in Equation 3 from Equations 1 and 2.

$$\begin{aligned} C(V) &= C_l + C_{st} \quad \text{Equation 3} \\ &= \varepsilon(v)\cdot(A/d)+(5/3)\cdot C0 \\ &= (1/3)\cdot(2V+1)\cdot C0+(5/3)\cdot C0 \\ &= (2/3)\cdot(V+3)\cdot C0 \end{aligned}$$

Since the charge Q supplied to the pixel is preserved, the following Equation 4 is established.

$$Q=C(V_{n-1})\cdot V_n=C(V_f)\cdot V_f \quad \text{Equation 4}$$

where $V_n$ represents the data voltage (or, an absolute value of the data voltage of an inverting driving method) to be supplied to the present frame, $C(V_{n-1})$ represents the capacitance corresponding to the pixel voltage of the to previous frame (that is, (n−1)th frame), and $C(V_f)$ represents the capacitance corresponding to the actual voltage $V_f$ of the pixel of the present frame (that is, n-th frame).

Equation 5 can be derived from Equations 3 and 4.

$$C(V_{n-1})\cdot V_n=C(V_f)\cdot V_f=(2/3)\cdot(V_{n-1}+3)\cdot V_n=(2/3)\cdot(V_f+3)\cdot V_f \quad \text{Equation 5}$$

Hence, the actual pixel voltage Vf can be expressed as Equation 6.

$$V_f=(-3+\sqrt{9+4V_n(V_{n-1}+3)})/2 \quad \text{Equation 6}$$

As clearly expressed in Equation 6, the actual pixel voltage $V_f$ is determined by the data voltage $V_n$ supplied to the present frame and the pixel voltage $V_{n-1}$ supplied to the previous frame.

If the data voltage supplied in order for the pixel voltage to reach the target voltage $V_n$ at the n-th frame is set to be $V_n'$, the data voltage $V_n'$ can be expressed as Equation 7 from Equation 5.

$$(V_{n-1}+3)\cdot V_n'=(V_n+3)\cdot V_n \quad \text{Equation 7}$$

Hence, the data voltage $V_n'$ can be expressed as Equation 8.

$$\begin{aligned} V_n' &= \frac{V_{n+3}}{V_{n-1}+3}\cdot V_n \quad \text{Equation 8} \\ &= V_n+\frac{V_n-V_{n-1}}{V_{n-1}+3}\cdot V_n \end{aligned}$$

As noted-above, when supplying the data voltage $V_n'$ obtained by the Equation 8 by the consideration of the target pixel voltage $V_n$ of the present frame and the pixel voltage $V_{n-1}$ of the previous frame, the pixel voltage can directly reach the target pixel voltage $V_n$.

Equation 8 is derived from FIG. 4 and a few assumptions, and the data voltage $V_n'$ applied to the general LCD can be expressed as Equation 9.

$$|V_n'|=|V_n|+f(|V_n|-|V_{n-1}|) \quad \text{Equation 9}$$

where the function $f$ is determined by the characteristics of the LCD. The function $f$ has the following characteristics.

That is, $f=0$ when $|V_n|=|V_{n-1}|$, $f>0$ when $|V_n|>|V_{n-1}|$, and $f<0$ when $|V_n|>|V_{n-1}|$.

A method for supplying the data voltage according to a first preferred embodiment of the present invention will now be described.

Figure 5:
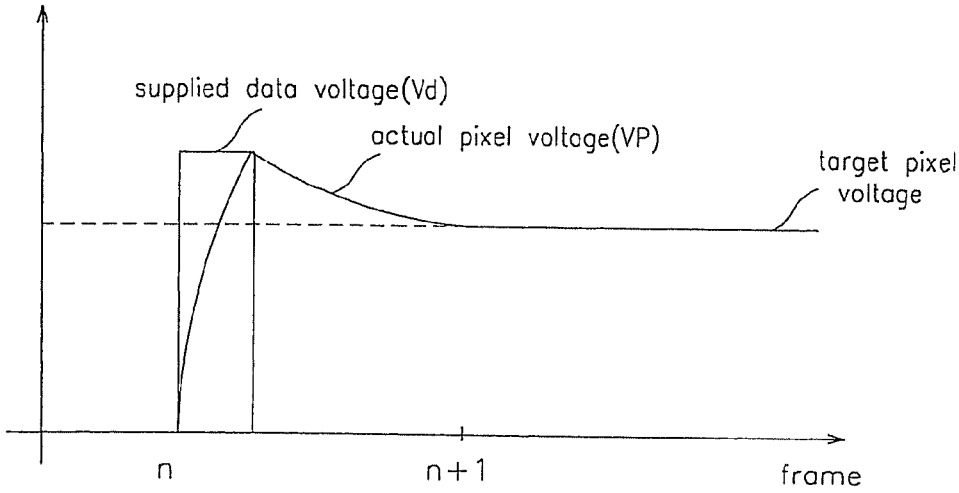
FIG. 5 shows a method for supplying the data voltage according to a first preferred embodiment of the present invention.

FIG. 5 shows the method for supplying the data voltage.

As shown in the first preferred embodiment, the data voltage $V_n'$ modified by consideration of the target pixel voltage of the present frame and the pixel voltage (data voltage) of the previous frame is supplied, and the pixel voltage $V_p$ reaches the target voltage. That is, in the case the target voltage of the present frame is different from the pixel voltage of the previous frame, the voltage higher (or lower) than the target voltage of the present frame is supplied as the modified data voltage so as to reach the target voltage level at the first frame, and after this, the target voltage is supplied as the data voltage at the following frames. Therefore, the response speed of the liquid crystal can be increased.

At this time, the modified data voltage (charges) is determined by consideration of the liquid crystal capacitance determined by the pixel voltage of the previous frame. That is, the charge Q is supplied by considering the pixel voltage level of the previous frame so as to directly reach the target voltage level at the first frame.

Figure 6:
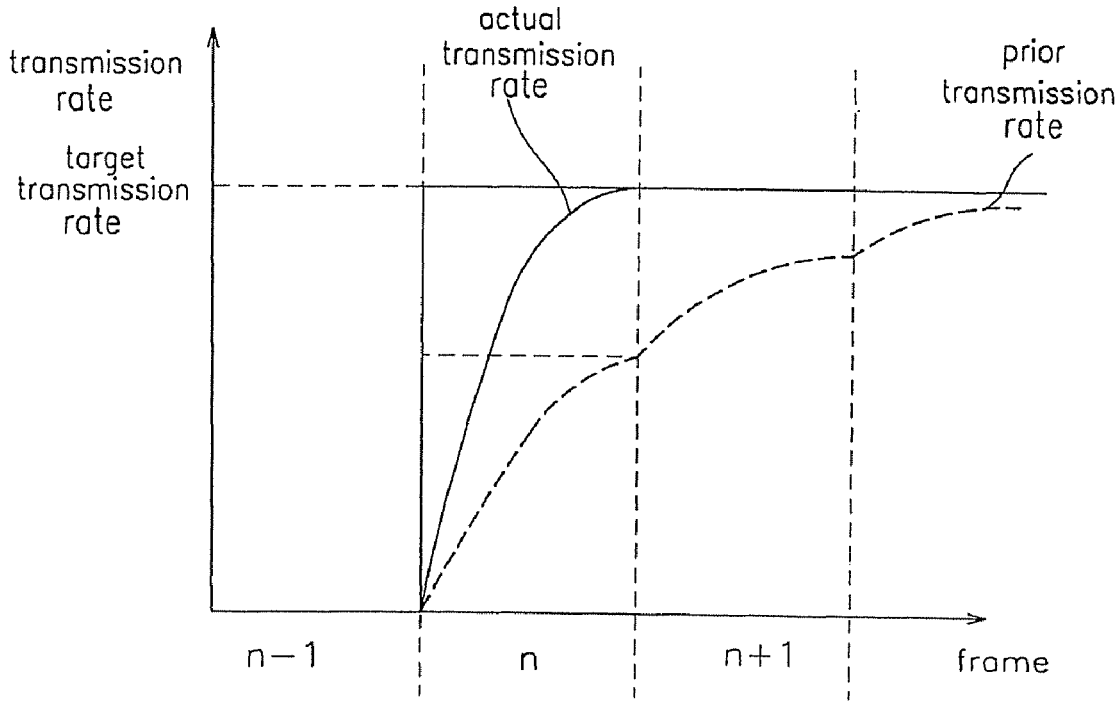
FIG. 6 shows a permittivity of the LCD in case of supplying the data voltage according to the first preferred embodiment of the present invention.

FIG. 6 shows a permittivity of the LCD in the case of supplying the data voltage according to the first preferred embodiment of the present invention. As shown, since the modified data voltage is supplied according to the first preferred embodiment, the permittivity directly reaches the target permittivity.

Figure 7:
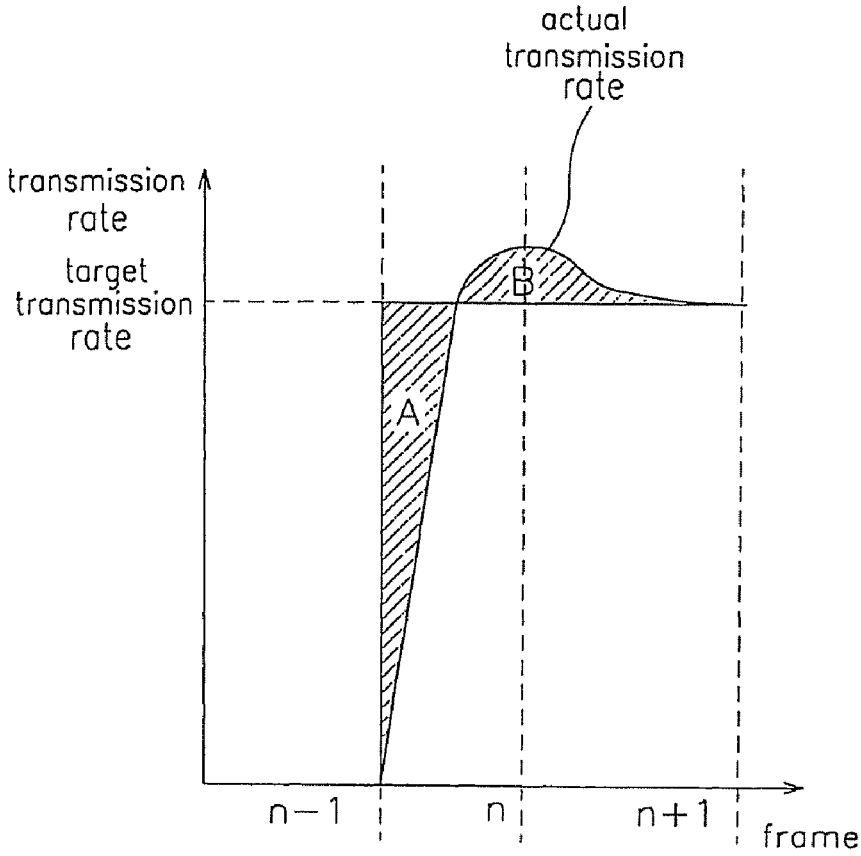
FIG. 7 shows a permittivity of the LCD in case of supplying the data voltage according to a second preferred embodiment of the present invention.

In a second preferred embodiment, a modified voltage $V_n'$ a little higher than the target voltage is supplied to the pixel voltage. As shown in FIG. 7, the permittivity becomes lower than the target permittivity before a half of the response time of the liquid crystal, but after this, the permittivity becomes overcompensated compared to the target value so that the average permittivity becomes equal to the target permittivity.

An LCD will now be described according to a preferred embodiment of the present invention.

Figure 8:
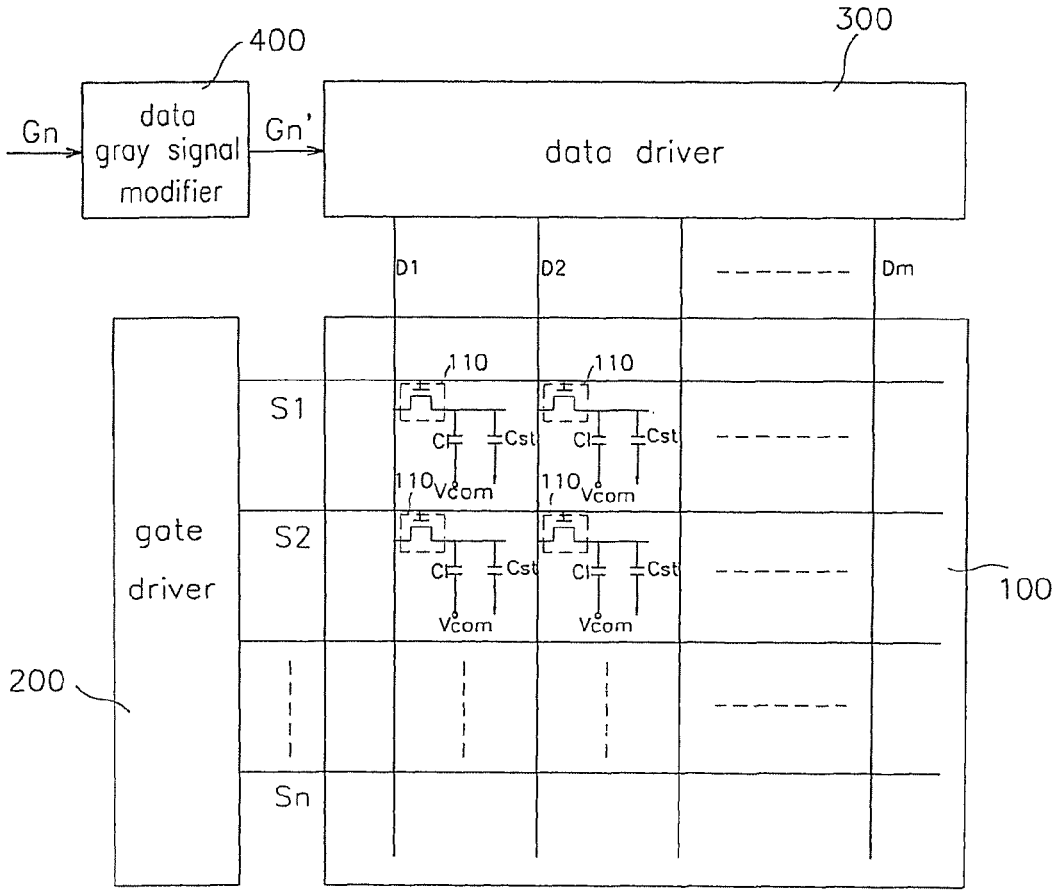
FIG. 8 shows an LCD according to the preferred embodiment of the present invention.

FIG. 8 shows an LCD according to the preferred embodiment of the present invention. The LCD according to the preferred embodiment uses a digital driving method.

As shown, the LCD comprises an LCD panel 100, a gate driver 200, a data driver 300 and a data gray signal modifier 400.

A plurality of gate lines S1, S2, . . . , Sn for transmitting gate ON signals, and a plurality of data lines D1, D2, . . . , Dn for transmitting the modified data voltages are formed on the LCD panel 100. An area surrounded by the gate lines and data lines forms a pixel, and the pixel comprises TFTs 110 having a gate electrode connected to the gate line and having a source electrode connected to the data line, a pixel capacitor C1 connected to a drain electrode of the TFT 110, and a storage capacitor $C_{st}$.

The gate driver 200 sequentially supplies the gate ON voltage to the gate lines so as to turn on the TFT having a gate electrode connected to the gate line to which the gate ON voltage is supplied.

The data gray signal modifier 400 receives n-bit data gray signals $G_n$ from a data gray signal source (e.g., a graphic signal controller), and outputs the m-bit modified data gray signals $G_n'$ by consideration of the m-bit data gray signals of the present and previous frames. At this time, the data gray signal modifier 400 can be a stand-alone unit or can be integrated into a graphic card or an LCD module.

The data driver 300 converts the modified gray signals $G_n'$ received from the data gray signal modifier 400 into corresponding gray voltages (data voltages) so as to supply the same to the data lines.

Figure 9:
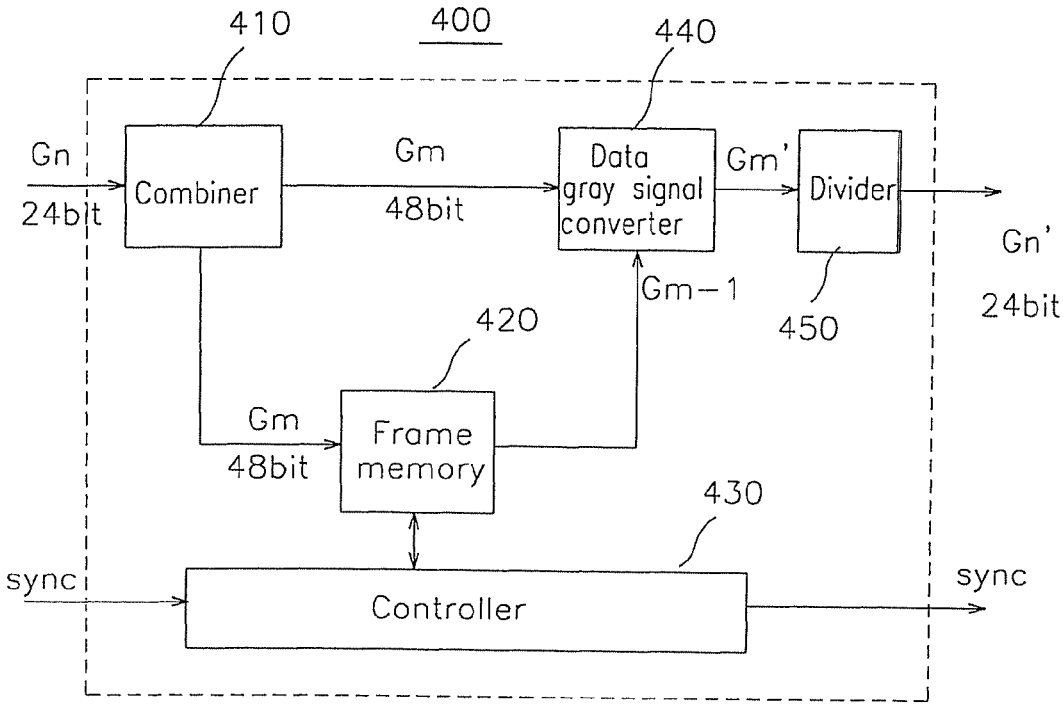
FIG. 9 shows a data gray signal modifier according to the preferred embodiment of the present invention.

FIG. 9 shows a detailed block diagram of the data gray signal modifier 400 of FIG. 8.

As shown, the data gray signal modifier 400 comprises a combiner 410, a frame memory 420, a controller 430, a data gray signal converter 440 and a divider 450. The combiner 410 receives gray signals from the data gray signal source, and converts the frequency of the data stream into a speed that can be processed by the data gray signal modifier 400. For example, if 24-bit data synchronized with the 65 MHz frequency are transmitted from the data gray signal source and the processing speed of the components of the data gray signal modifier 400 is limited within 50 MHz, the combiner 410 combines the 24-bit gray signals into 48-bit gray signals $G_m$ two by two and then transmits the same to the frame memory 420.

The combined gray signals $G_m$ output the previous gray signals $G_{m-1}$ stored in a predetermined address to the data gray signal converter 440 according to a control process by the controller 430 and concurrently stores the gray signals $G_m$ transmitted by the combiner 410 in the above-noted address. The data gray signal converter 440 receives the present frame gray signals $G_m$ output by the combiner and the previous frame gray signals $G_{m-1}$ output by the frame memory 420, and generates modified gray signals $G_m'$ by processing the gray signals of the present and previous frames.

The divider 450 divides 48-bit modified data gray signals $G_m'$ output by the data gray signal converter 440 and outputs 24-bit modified gray signals $G_n'$.

In the preferred embodiment of the present invention, since the clock frequency synchronized to the data gray signal is different from that for accessing the frame memory 420, the combiner 410 and the divider 450 are needed, but in the case the clock frequency synchronized to the data gray signal is identical with that for accessing the frame memory 420, the combiner 410 and the divider 450 are not needed.

Any digital circuits that satisfy the above-defined equation 9 can be manufactured as the data gray signal converter 440.

Also, in the case a lookup table is made and stored in a read only memory (ROM), the gray signals can be modified by accessing the lookup table.

Since the modified gray voltage $V_n'$ is not only proportional to the difference between the data voltage $V_{n-1}$ of the previous frame and the $V_n$ of the previous frame but also depends on their respective absolute values, the configuration of the lookup table makes the circuit more easy compared to the computation process.

In order to modify the data voltage according to the preferred embodiment of the present invention, a dynamic range wider than the actually used gray scale range must be used. In the analog circuits, this problem can be solved using high voltage integrated circuits, but in the digital circuit, the number of the grays is restricted. For example, in the 6-bit gray case, a portion of the 64 gray levels has to be assigned not for the actual gray representation but for the modified voltage. That is, a portion of the gray level should be assigned for modification of the voltage, and hence the number of the grays to be represented is reduced.

In order to prevent the reduction of the number of the grays, a truncation concept can be introduced. For example, it is assumed that the voltage from 0 to 8V is necessary when the liquid crystal is activated at voltage from 1 to 4V and a modification voltage is considered. At this time, when dividing the voltage having the range from 0 to 8V into 64 levels in order to perform a full modification, the number of the grays which can be actually represented becomes about 30 at most. Therefore, in the case the range of the voltage becomes 1 to 4V and the modified voltage $V_n'$ becomes greater than 4V, the number of the grays can be reduced if truncating all the modification voltages to 4V.

FIG. 10 shows a configuration of the lookup table to which the concept of the truncation is introduced according to the preferred embodiment of the present invention.

In the preferred embodiments of the present invention, the LCD driven by a digital method is described, and also the present invention can be applied to the LCD driven by an analog method.

In this case, a data gray signal modifier which functions corresponding to the data gray signal modifier as described in FIG. 8 is needed, and this data gray signal modifier can be implemented using an analog circuit that satisfies the equation 9.

As described above, the pixel voltage reaches the target voltage level as the data voltage is modified and the modified data voltage is provided to the pixels. Therefore, the configuration of the TFT LCD panel is not needed to be changed and the response speed of the liquid crystal can be improved.

Figure 11:
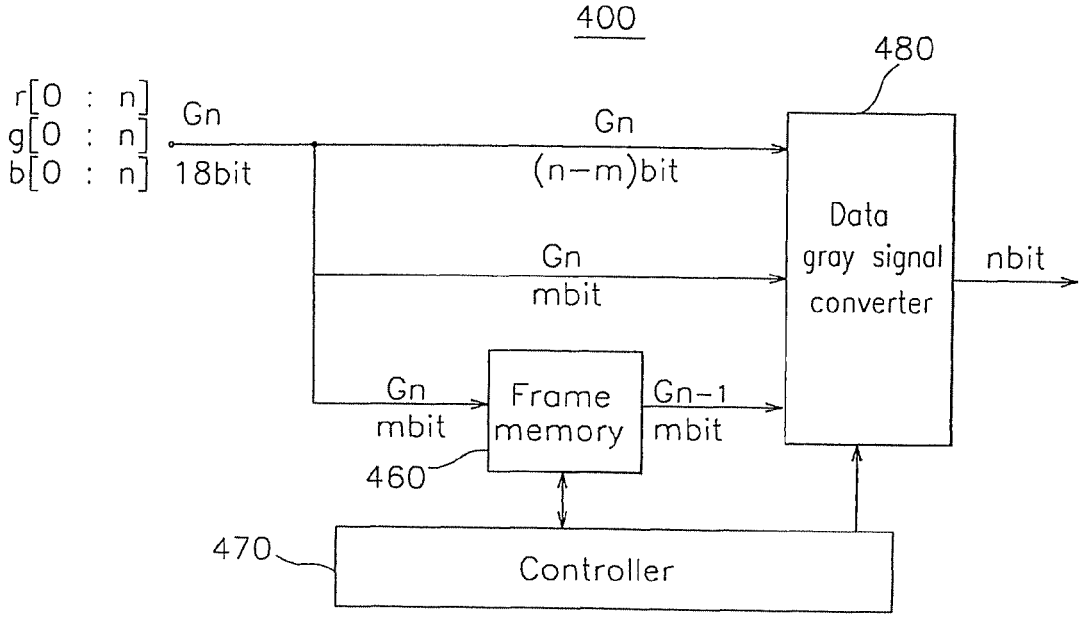
FIG. 11 shows a data gray signal modifier according to a second embodiment of the present invention.

FIG. 11 shows a detailed block diagram of the data gray signal modifier 400 according to a second preferred embodiment of the present invention.

As shown, the data gray signal modifier 400 comprises a frame memory 460, a controller 470 and a data gray signal converter 480, and receives n-bit gray signals of the respective red (R), green (G) and blue (B) from the data gray signal source. Therefore, the total number of bits of the gray signals transmitted to the data gray signal converter 480 becomes (3×n) bits. Here, a skilled person can make either the (3×n)-bit gray signals be concurrently supplied to the data gray signal modifier 480 from the data gray signal source, or make the respective n-bit R, G and B gray signals be sequentially supplied to the same.

Referring to FIG. 11, the frame memory 460 fixes the bit of the gray signal to be modified. The frame memory 460 receives m bits of the n-bit R, G and B gray signals from the data gray signal source, stores the same in predetermined addresses corresponding to the R, G and B, and outputs the same to the data gray signal converter 480 after a single frame delay. That is, the frame memory 460 receives the m-bit gray signals $G_n$ of the present frame and outputs m-bit gray signals $G_{n-1}$ of the previous frame.

The data gray signal converter 480 receives (n−m) bits of the present frame $G_n$ which are passed through without modification, m bits of the present frame received for modification, and m bits of the previous frame $G_{n-1}$ delayed by the frame memory 460, and then generates the modified gray signals $G_n'$ by considering the m bits of the present and previous frames.

Figure 12:
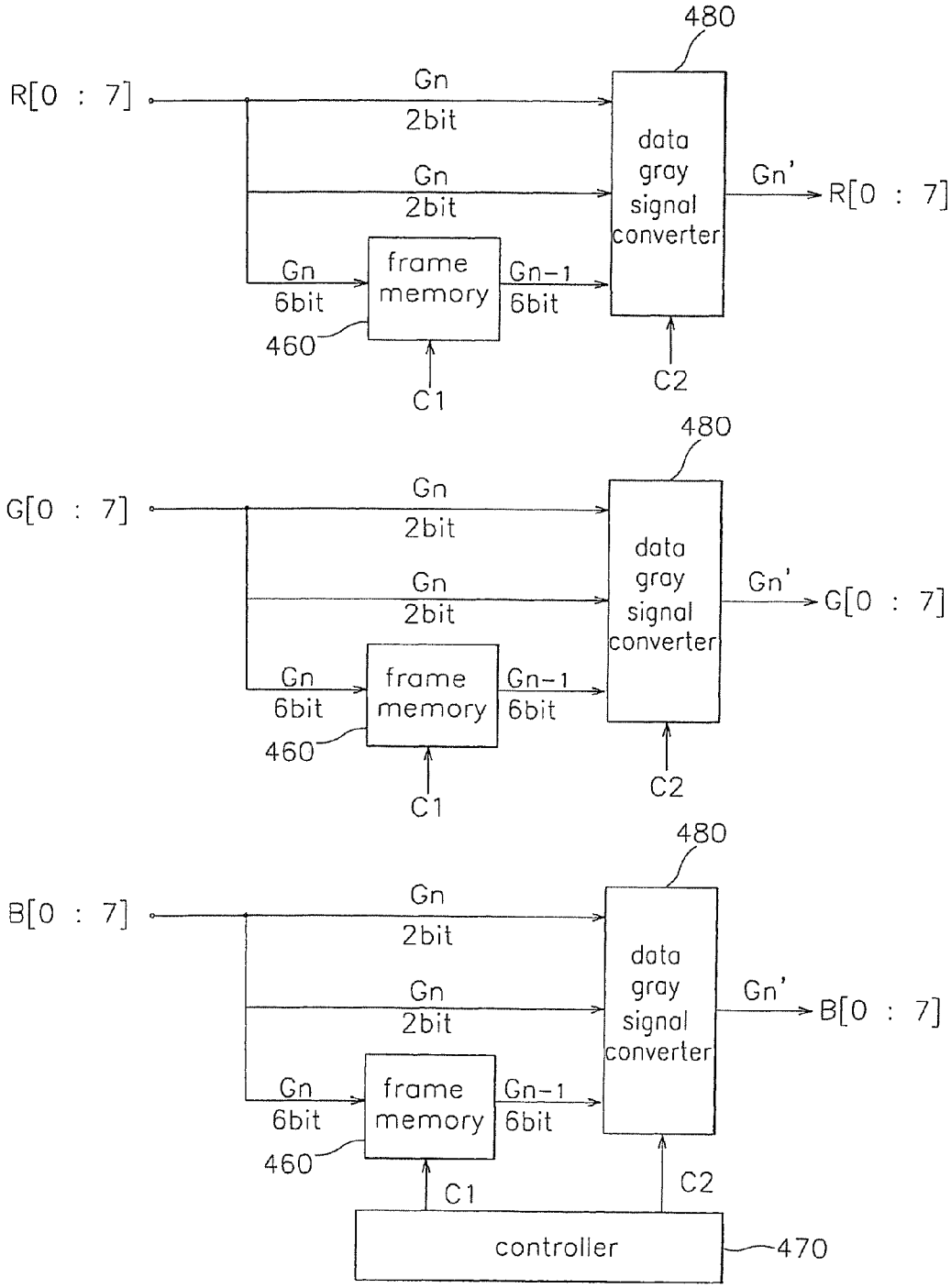
FIG. 12 conceptually shows an operation of the data gray signal modifier according to the first preferred embodiment of the present invention shown in FIG. 11.

The above-noted description will now be further provided, with reference to FIG. 12.

FIG. 12 conceptually shows an operation of the data gray signal modifier according to the first preferred embodiment of the present invention. It is assumed that the R, G and B gray signals transmitted to the data gray signal modifier 400 from the data gray signal source are respectively 8-bit signals.

Two bits (bits of the present frame) starting from the LSB among 8-bit gray signals transmitted to the data gray signal modifier 400 are not modified, and they are input to the data gray signal converter 480. The remaining 6 bits of the present frame are input to the data gray signal converter 480 for modification and concurrently stored in predetermined addresses of the frame memory 460.

Here, since the frame memory 460 stores the bit of the present frame during a single frame period and then outputs the same, 6-bit gray signals of the previous frame are output to the data gray signal converter 480.

The data gray signal converter 480 receives 6-bit gray signals of the present frame and 6-bit R gray signals of the previous frame, generates modified gray signals considering the 6-bit R gray signals of the previous and present frames, adds the generated 6-bit gray signals and the 2-bit LSB gray signals of the present frame, and outputs finally modified 8-bit gray signals $G_n'$.

In the same manner as with the R gray signals, the data gray signal converter 480 outputs modified 8-bit G and B gray signals considering the 6-bit gray signals of the present and previous frames. The 8-bit modified gray signals are converted into corresponding voltages by a data driver and supplied to the data lines.

Here, the 6-bit R, G and B gray signals are stored in the established addresses of the frame memory 460. A skilled person can use a single frame memory 460 to assign the addresses for covering the R, G and B, or use three frame memories for the respective R, G and B to function as a single frame.

Through the description referred to in FIG. 12, when 8-bit gray signals are input from the data gray signal source, the prior frame memory stores 8-bit R, G and B gray signals in the case of SXGA (1,280×1,024), and therefore at least 30 Mb memories are necessary, but the frame memory 460 according to the preferred embodiment of the present invention only stores 6-bit gray signals, thereby reducing memory capacity needed.

Here, the more the number of the bits of the gray signals stored in the frame memory 460 becomes lower, the more the capacity needs of the frame memory 460 become lower, compared to the prior art.

An operation of the data gray signal modifier according to the second preferred embodiment will now be described.

Figure 13:
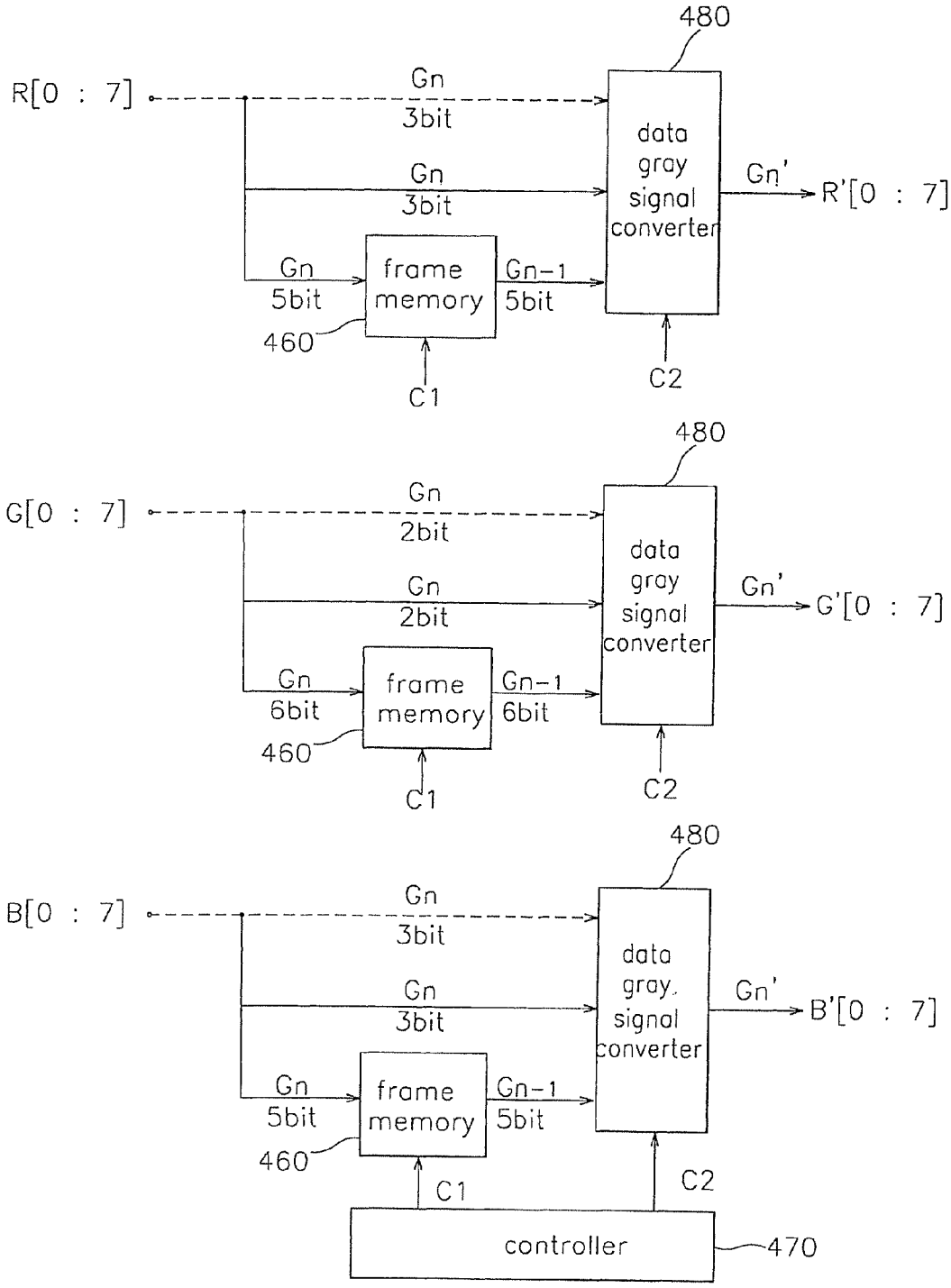
FIG. 13 conceptually shows an operation of the data gray signal modifier according to the second preferred embodiment of the present invention shown in FIG. 11.

FIG. 13 conceptually shows an operation of the data gray signal modifier according to the second preferred embodiment of the present invention. For easy understanding, the data gray signal modifier is designed using one frame memory and one data gray signal converter. However, the number of the frame memories and the data gray signal converters can be changed according to grades of the LCD panels, the bit number of the gray signals, and designer's intention. For example, three memories for configuring the frame memory and the data gray signal converter can be used to process R, G and B.

A skilled person can configure the frame memory by using first and second memories for processing reading and writing processes corresponding to the respective R, G and B gray signals so as to enhance data processing speed.

That is, when the gray signals are sequentially input to the frame memory, odd-numbered gray signals are stored in the first memory, and even-numbered gray signals are stored in the second memory, and when the odd-numbered gray signals are stored in the first memory, the second memory reads the first memory, and when the even-numbered gray signals are stored in the second memory, the first memory reads the second memory so that the data can be written/read to from the frame memory within a shorter time.

Referring to FIG. 13, the configuration of the data gray signal modifier 400 is identical with that of the first preferred embodiment. However, the data gray signal modifier 400 according to the second preferred embodiment is different from that of the first preferred embodiment in that the data gray signal modifier 400 according to the second preferred embodiment reduces the bit number of the output gray signals compared to the bit number of the input gray signals. An operation of the data gray signal modifier 400 will now be described.

When the 8-bit R, G and B gray signals are provided by the data gray signal source, the lower 3 bits of the 8-bit R gray signals are not modified and are passed though the dotted line in the figure, and the remaining 5 bits of the present frame are input to the data gray signal converter 480 and the frame memory 460.

The 5-bit R gray signals of the present frame input to the frame memory 460 are stored in predetermined addresses and then output at the next frame, and 5-bit R gray signals of the previous frame are output to the data gray signal converter 480. The data gray signal converter 480 then receives the 5-bit R gray signals of the present and previous frames $G_n$ and $G_{n-1}$, generates the modified gray signals $G_n'$ proportional to the differences between the gray signals of the present and previous frames, and outputs the same. At this time, the modified R gray signals $G_n'$ are 8-bit signals obtained by an addition of the modified 5 bits and the unmodified 3 bits.

Two bits of the 8-bit G gray signals are passed via the dotted line, and remaining 6-bit gray signals $G_n$ are input to the data gray signal converter 480 and the frame memory 460. Here, the frame memory 460 stores the 6-bit G gray signals of the present frame in a predetermined address, and outputs the 6-bit G gray signals of the previous frame $G_{n-1}$. Therefore, the data gray signal converter 480 outputs the modified gray signals $G_n'$ using the 6-bit G gray signals of the present and previous frames. At this time, the modified G gray signals $G_n'$ are obtained by an addition of the modified 6 bits and unmodified 2 bits.

Finally, 3 bits of the 8-bit B gray signals are passed via the dotted line, and remaining 5-bit gray signals $G_n$ are input to the data gray signal converter 480 and the frame memory 460. Here, the frame memory 460 stores the 5-bit G gray signals of the present frame in a predetermined address and outputs the 5-bit G gray signals of the previous frame $G_{n-1}$. Hence, the data gray signal converter 480 outputs modified gray signals $G_n'$ by using the 5-bit G gray signals of the present and previous frames. At this time, the modified G gray signals $G_n'$ are 8 bits obtained by an addition of the modified 5 bits and unmodified 3 bits.

As described above, it is preferable that the passed bits among the 8-bit R, G and B gray signals start from the LSB, and a skilled person can change the number of the passed bits. Hence, the skilled person can change the capacity and number of the frame memories and modify the data gray signal converter.

A digital circuit that satisfies Equation 9 can be manufactured as the data gray signal converter 480 according to the preferred embodiment, or a look-up table is made and then stored into a read only memory (ROM), and accessed to modify the gray signals. Since the modified data voltage $V_n'$ is not only proportional to the difference between the data voltage $V_{n-1}$ of the previous frame and that of the present frame, but is also dependent on absolute values of the data voltages, the look-up table makes the configuration of the circuit simpler than computation.

Referring to FIGS. 12 and 13, an example of a case in which an LCD panel is the SXGA (1,280×1,024) type and 8-bit gray signals are supplied will now be described.

Conventionally, in this case, the frame memory requires at least 30 Mb, and the data gray signal converter requires 512 Kb×6 when processing two R, G and B pixels per clock signal of the control signals output by the controller 470, and it requires 512 Kb×3 when processing one R, G and B pixel per clock signal.

In detail, in the case of processing two pixels per clock signal, the data gray signal modifier 400 receives 48-bit signals. Since the bus size of the memory is configured as ×4, ×8, ×16 and ×32, the 48-bit bus is configured using three 16-bit wide memories.

However, since the bits from the LSB to the i (i=1, 2, . . . , n−1) among the n bits are modified and the remaining parts are not modified in the preferred embodiment of the present invention, the capacity of the frame memory and the data gray signal converter can be reduced.

For example, when n=8 and i=2, since six MSBs are needed to be modified and the remaining two bits are not needed to be modified, the frame memory only needs the capacity of 1,280×1,024×6 bits=22.5 Mb, and since the data gray signal converter can use six bits instead of an 8-bit gray table memory (512 Kb), the size is greatly reduced to 24 Kb in the case of one pixel per clock signal, and reduced to 6×24 Kb in the case of two pixels per clock signal.

In the preferred embodiment, a number of modification bits are omitted in the modification of the gray signals since human eyes are not as sensitive to moving pictures as to still pictures, and therefore it is desirable to omit a number of modification bits within ranges wherein the human eyes cannot discern the variation of the gray signals of the moving pictures.

Since peoples' eyes have different sensitivity with respect to R, G and B, it is desirable to differently omit the number of modification bits with respect to the gray signals of the corresponding color. That is, since human eyes are most sensitive to green and least sensitive to blue, it is desirable that the number of modification bits i' be in the order of G≦R≦B.

According to the present invention, the data voltage is modified and the modified data voltage is supplied to the pixels so that the pixel voltage reaches the target voltage level. Hence, the response speed of the liquid crystal can be improved without changing the configuration of the TFT-LCD panel.

Further, since only 'm' bits among n-bit gray signals are used, the number and capacity of the memory needed for modification of the data voltage can be reduced, thereby increasing yield of the panels and reducing the cost.

As described above, an image signal modification circuit for improving the response speed of the liquid crystal is shown in FIGS. 9 and 11.

Particularly, in order to reduce the cost of the image signal modification circuit, the gray signals except a portion of the LSB are modified, and this algorithm is simple and easy to apply.

However, in the case of modifying four bits of the 8-bit gray, two problems caused by quantization can be generated as follows.

It is assumed that the response speed becomes maximized when 168 (10101000) gray level ($G_n'$) is defined as the DCC modification value in the case 208 (11010000) gray level ($G_{n-1}$) is switched to 192 (11000000) gray level ($G_n$). A modification of the full 8 bits generates no problem, but a modification of MSB 4 bits so as to reduce the cost, the value 168 can not be provided to the gray lookup table. Therefore, the value of 176 (10110000) or 160 (10100000) is input to the lookup table instead. That is, modification errors are generated as much as the omitted LSB bits. This can generate a greater problem in the following interval.

TABLE 1

| | | Gn − 1 | | | | | | | | | | | | | | | | |
|---|---|---|---|---|---|---|---|---|---|---|---|---|---|---|---|---|---|---|
| Gn' | | 1 | 16 | 32 | 48 | 64 | 80 | 96 | 112 | 128 | 144 | 160 | 176 | 192 | 208 | 224 | 240 | 255 |
| Gn | 32 | 33 | 33 | 32 | 30 | 28 | 26 | 24 | 22 | 20 | 16 | 12 | 9 | 9 | 9 | 0 | 0 | 0 |

In this interval, the modification is gradually performed. In the case of configuring this interval using only 4 bits, it becomes as follows.

TABLE 2

| | | Gn − 1 | | | | | | | | | | | | | | | | |
|---|---|---|---|---|---|---|---|---|---|---|---|---|---|---|---|---|---|---|
| Gn' | | 0 | 16 | 32 | 48 | 64 | 80 | 96 | 112 | 128 | 144 | 160 | 176 | 192 | 208 | 224 | 240 | 255 |
| Gn | 32 | 32 | 32 | 32 | 32 | 32 | 32 | 32 | 16 | 16 | 16 | 16 | 16 | 0 | 0 | 0 | 0 | 0 |

The second problem is as follows.

In the like manner of the previous example, if it is assumed that 1 176 gray level is provided as a modification value when the 208 gray level is switched to the 192 gray level, the 176 or 175 gray level must be provided to obtain a maximum liquid crystal response speed when the 207 gray level is switched to the 192 gray level.

However, in the case of modifying only 4 bits, since the MSB 4 bits of 207 (11001111) is identical with that of 192 (11000000), the modification is not performed and the 192 is output.

Particularly, in the case of moving pictures, the grays of 209 and 207 gray levels are distributed on a uniform screen of about 208 gray level, and although the difference between the 208 and 207 gray levels is 1, degrees of compensation become greater, and accordingly, some displayed stains may look exaggerated.

The above-noted two problems are referred to as the quantization errors, and when the number of the LSBs which are not modified but omitted is increased, the quantization errors become severe.

An LCD for reducing the quantization errors will now be described.

Figure 14:
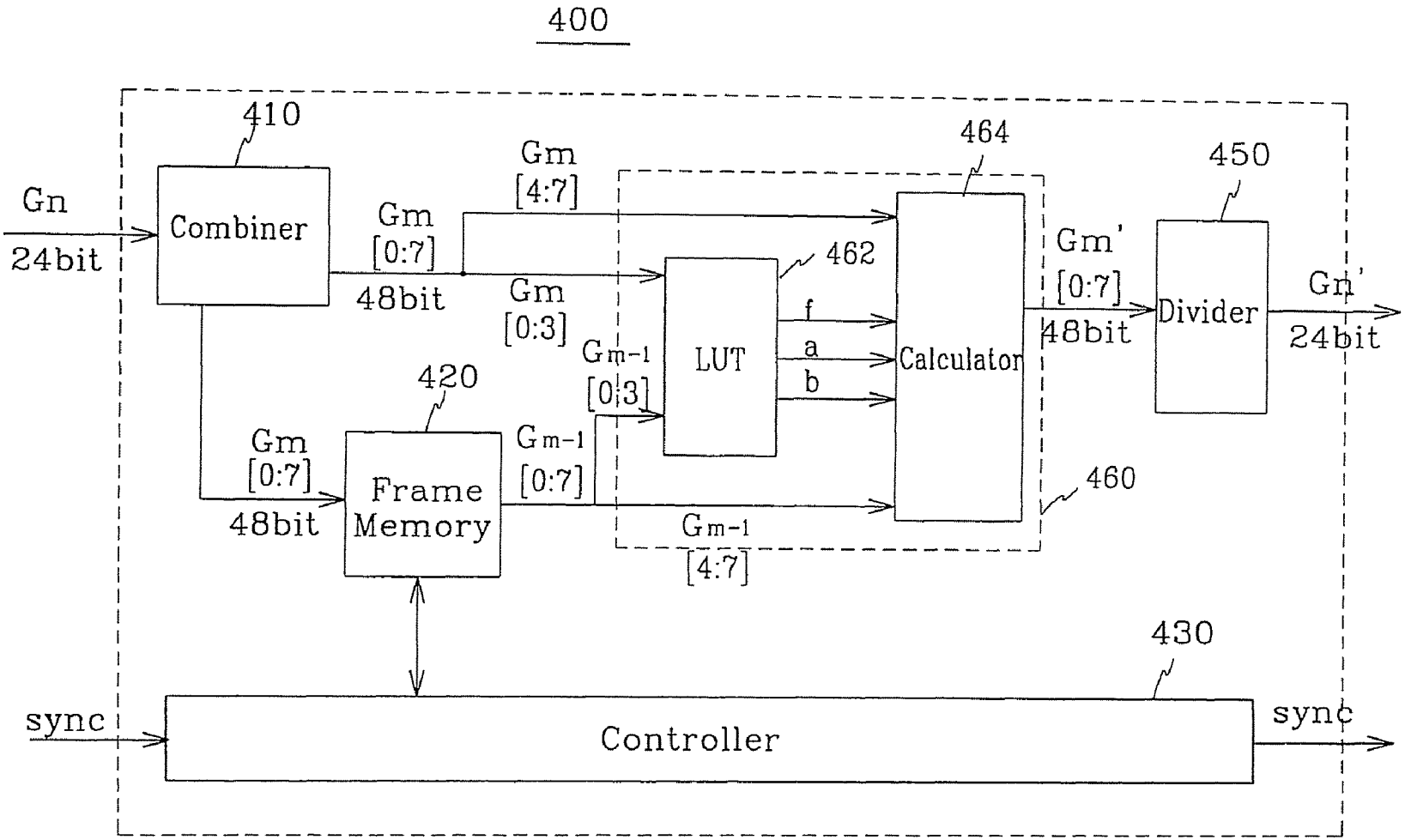
FIG. 14 shows a data gray signal modifier according to a third embodiment of the present invention.

FIG. 14 shows a data gray signal modifier according to a third embodiment of the present invention. Repeated portions compared to FIG. 9 will be assigned with identical reference numerals and no further description will be provided.

Referring to FIG. 14, the data gray signal converter 460 of the data gray signal modifier comprises a lookup table 462 and a calculator 464.

As MSB 4-bit gray data $G_m[0:3]$ of the present frame and MSB 4-bit gray data $G_{m-1}[0:3]$ of the previous frame are provided by the combiner 410, the values f, a and b stored in the lookup table are extracted and provided to the calculator 464.

The calculator 464 receives the LSB 4-bit gray data $G_m[4:7]$ of the present frame from the combiner 410, the LSB 4-bit gray data $G_{m-1}[4:7]$ of the to previous frame from the frame memory 420, the variables f, a and b for modification of the moving pictures from the lookup table, and performs a predetermined computation and outputs first modified gray data $G_m'[0:7]$ to the divider 450.

The first modified 36-bit gray data provided to the divider 450 are divided, and the modified 24-bit gray data $G_n'$ are output to the data driver 300.

In the preferred embodiments of the present invention as shown in FIG. 8, the LCD driven by a digital method is described, and also the present invention can be applied to the LCD driven by an analog method.

According to a second preferred embodiment of the present invention, effects of reduction of the quantization errors will now be described in detail.

First, if the total gray levels are set to be x bits, the MSB y bits of the x bits are modified using the gray lookup table and the remaining z bits, that is (x−y) bits are modified by computation.

An example will now be described when x=8 and y=4.

For ease of explanation, the following will be defined. [A]n is a multiple of the maximum $2^n$ not greater than A. For example, $[207]_4=[206]_4=[205]4=\ldots=[193]_4=[192]_4=192$.

That is, $[A]_n$ is a value representing that zeros are provided to all the LSB n bits of A, ${}_m[A]$ is a value representing that zeros are provided to all the MSB m bits of A, and ${}_m[A]_n$ is a value representing that zeros are provided to all the LSB n bits and MSB m bits of A. When a mapping according to the gray lookup table for modification is set to be $f(G_n, G_{n-1})$, the modification of the present invention is as follows.

$$G_n' = f([G_n]_4, [G_{n-1}]_4) + a([G_n]_4, [G_{n-1}]_4)\cdot\frac{4[G_n]}{16} - b([G_n]_4, [G_{n-1}]_4)\cdot\frac{4[G_n]}{16} \quad \text{Equation 10}$$

where $[G_n]_4$ represents that zeros are provided to all the LSB 4 bits of Gn, $[G_{n-1}]_4$ represents that zeros are provided to all the LSB 4 bits of $G_{n-1}$, $4[G_n]$ represents that zeros are provided to all the MSB 4 bits of $G_n$, and a and b are positive integers.

According to the equation 10, the quantization errors can be reduced by using the gray lookup table.

The f, a and b are given as follows.

$$f([G_n]_4,[G_{n-1}]_4)=G_n'([G_n]_4,[G_{n-1}]_4)$$

$$a([G_n]_4,[G_{n-1}]_4)=G_n'([G_n]_4+16,[G_{n-1}]_4)-G_n'([G_n]_4,[G_{n-1}]_4)$$

$$b([G_n]_4,[G_{n-1}]_4)=G_n'([G_n]_4,[G_{n-1}]_4)-G_n'([G_n]_4,[G_{n-1}]_4+16)$$

It is assumed that a gray lookup table for modification is obtained as shown in FIG. 3.

TABLE 3

| | | Gn−1 | |
|---|---|---|---|
| | Gn' | 64 | 80 |
| Gn | 128 | 140 | 136 |
| | 144 | 160 | 158 |

For example, if it is set that $[G_n]_4=128$ and $[G_{n-1}]4=64$, then it becomes that $f([G_n]_4,[G_{n-1}]_4)=140$, $a([G_n]_4,[G_{n-1}]_4)=160-140=20$, and $b([G_n]_4,[G_{n-1}]_4)=140-136=4$. However, these values are not absolute and the values are determined so that the values in the 16×16 interval may be approximated with minimized errors.

For example, when approximating the case of $G_n=144$ and $G_{n-1}=80$ by using the equation 10, since Gn'=140+20×16/16−4×16/16=156, the value is different from the actually measured value 158. This error can be ignored, but if the error becomes greater, the error of the values in the 16×16 interval can be minimized by precisely adjusting the values of f, a and b.

An exceptional case is a block of $[G_n]_4=[G_{n-1}]_4$. In this case, since a state that $G_n'=G_n$ must be maintained, a state that $f=[G_n]_4$ is fixed and the values of a and b are adjusted according to the state. If $G_n=G_{n-1}$ in the equation 10, when it becomes that a−b=16, then the state that $G_n'=G_n$ is satisfied.

An example will be described in order to describe the modified gray data computed using the equation 10.

Figure 15A:
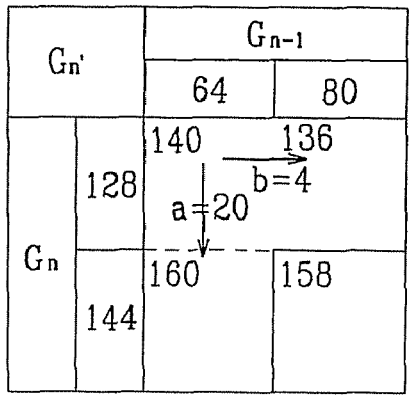
FIGS. 15(*a*) to 15(*c*) show a conversion process of the modified gray data computed according to the third preferred embodiment of the present invention.
Figure 15B:
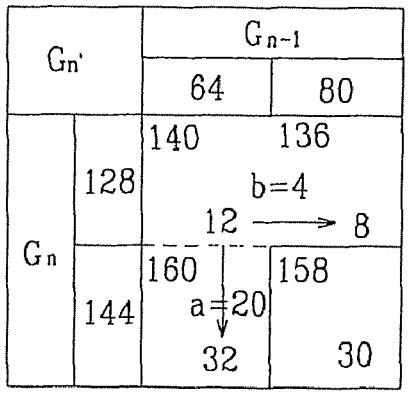
Figure 15C:
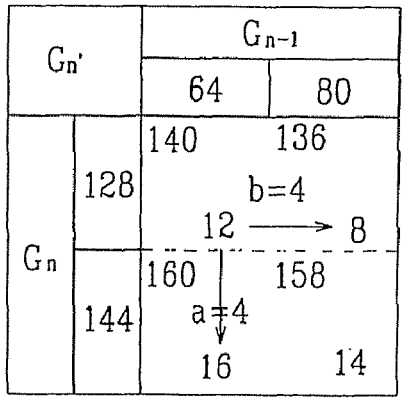
Figure 16:
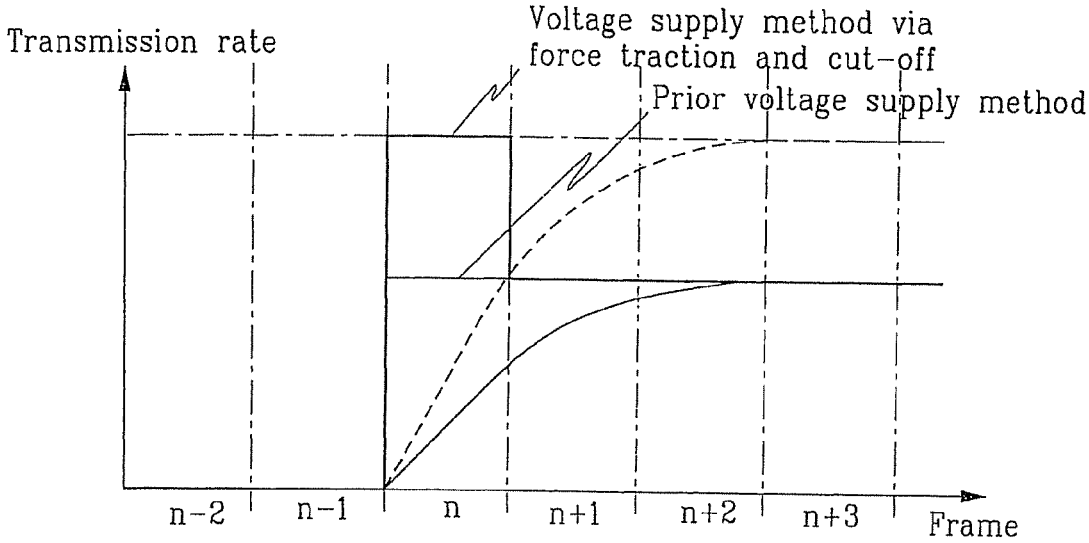
FIG. 16 shows a waveform diagram for comparing the conventional voltage supply method with that according to the preferred embodiment of the present invention.

For example, when a previous gray data $G_{n-1}$ is a 72 gray level and a present gray data $G_n$ is a 136 gray level, since the gray lookup table of the table 3 does not have the above-noted gray data, these values must be obtained by a predetermined computation as shown in FIG. 15(*a*).

That is, since $f([G_n]_4,[G_{n-1}]_4)=f([136]_4,[72]_4)$, it is satisfied that f(128,64)=140, $a([G_n]_4,[G_{n-1}]_4)=160-140=20$ and $b([G_n]_4,[G_{n-1}]_4)=140-136=4$.

Hence, when substituting the values for the equation 10, it becomes that $G_n'=140+20\times(136-128)/16-4\times(72-64)/16=148$.

Also, in order to reduce the number of the bits stored in the lookup table, subsequent equation 11 can be used.

$$G_n' = f' + [G_n]_4 + a\cdot([G_n]_4, [G_{n-1}]_4)\cdot\frac{{}_4[G_n]}{16} - b\cdot([G_n]_4, [G_{n-1}]_4)\cdot\frac{{}_4[G_n]}{16} \quad \text{Equation 11}$$

where it is defined that $f'=f([G_n]_4,[G_{n-1}]_4)-[G_n]_4$, and $[G_n]_4$ represents that zeros are provided to all the LSB 4 bits of $G_n$, and $[G_{n-1}]_4$ represents that zeros are provided to all the LSB 4 bits of $G_{n-1}$, and ${}_4[G_n]$ represents that zeros are provided to all the MSB 4 bits of $G_n$, and the values a and b are positive integers.

An example will be described in order to describe the modified gray data computed using the equation 11.

For example, when a previous gray data $G_{n-1}$ is a 72 gray level and a present gray data $G_n$ is a 136 gray level, since the gray lookup table of the table 3 does not have the above-noted gray data, these values must be obtained by a predetermined computation as shown in FIG. 15(*c*).

That is, $f'=f([G_n]_4,[G_{n-1}]_4)-[G_n]_4=f([136]_4,[72]_4)-128=f(128,64)-128=140-128=12$, $a''([G_n]_4,[G_{n-1}]_4)=a'(G_n)_4,[G_{n-1}]_4)+2^4=4+16=20$ and $b([G_n]_4,[G_{n-1}]_4)=4$.

Hence, when substituting the values for the equation 11, it becomes that $G_n'=128+12+20\times(136-128)/16-4\times(72-64)/16=148$.

Also, in order to reduce the number of the bits stored in the lookup table, subsequent equation 12 can be used.

$$G_n' = f'([G_n]_4, [G_{n-1}]_z) + G_n + a'\cdot([G_n]_4, [G_{n-1}]_4)\cdot\frac{{}_4[G_n]}{16} - b\cdot([G_n]_4, [G_{n-1}]_4)\cdot\frac{{}_4[G_n]}{16} \quad \text{Equation 12}$$

where it is defined that $f'=f-G_n$, and $[G_n]_4$ represents that zeros are provided to all the LSB 4 bits of $G_n$, and $[G_{n-1}]_4$ represents that zeros are provided to all the LSB 4 bits of $G_{n-1}$, and ${}_4[G_n]$ represents that zeros are provided to all the MSB 4 bits of $G_n$, and the value a' is an integer, and the value b is a positive integer.

That is, it becomes that $a'([G_n]_4,[G_{n-1}]_4)=a([G_n]_4,[G_{n-1}]_4)-2^4$.

An example will be described in order to describe the modified gray data computed using the equation 12.

For example, when a previous gray data $G_{n-1}$ is a 72 gray level and a present gray data $G_n$ is a 136 gray level, since the gray lookup table of the table 3 does not have the above-noted gray data, these values must be obtained by a predetermined computation as shown in FIG. 15(*b*).

That is, since $f([G_n]_4,[G_{n-1}]_4)=f([136]_4,[72]_4)=f(128,64)=140$, it is satisfied that $f'=f([G_n]_4,[G_{n-1}]_4)-G_n=140-128=12$, $G_n=136$, $a'([G_n]_4,[G_{n-1}]_4)=a'-16=4$ and $b([G_n]_4,[G_{n-1}]_4)=4$.

Hence, when substituting the values for the equation 12, it becomes that $G_n'=132+12+4\times(136-128)/16-4\times(72-64)/16=148$.

In this case, since the value of a' becomes smaller, the number of the bits assigned to (−16)a' can be reduced, but a' can be negative number in some intervals, and accordingly, an additional sign bit must be assigned.

As described above, the size of the lookup table for the modified gray to data becomes smaller in order of equations 10, 11 and 12, and the logic complication increases on the contrary.

In the above, modification of 8 bits is described.

However, all the 8-bit data may not be stored when the capacity of the frame memory or the number of input/output pins should be reduced.

For example, since dimensions of a DRAM include ×4, ×8, ×16 and ×32, the dimension of ×32 should be used so as to store 24-bit color information of the respective R, G and B, but it costs a lot. Instead of the dimension of ×32, a dimension of ×16 can be used, and 5-bit R, 6-bit G and 5-bit G can only be stored. The modification in this case is executed as follows.

That is, in the case of 6 bits, the modification gray values are output as follows.

$$G_n' = f([G_n]_4, [G_{n-1}]_4) + a\cdot([G_n]_4, [G_{n-1}]_4)\cdot\frac{{}_4[G_n]}{16} - b\cdot([G_n]_4, [G_{n-1}]_4)\cdot\frac{{}_4[G_n]\rangle\rangle 2}{4} \quad \text{Equation 13}$$

where it is defined that $[G_n]_4$ represents that zeros are provided to all the LSB 4 bits of $G_n$, and $[G_{n-1}]_4$ represents that zeros are provided to all the LSB 4 bits of $G_{n-1}$, and ${}_4[G_n]$ represents that zeros are provided to all the MSB 4 bits of $G_n$, and the values a and b are positive integers, and ${}_4[G_n]>>2$ functions such that binary data of the computed ${}_4[G_n]_2$ are shifted in the right direction by 2 bits, and as a result, it functions as division by $2^2$.

Also, in the case of 5 bits, the modification gray values are output as follows.

$$G_n' = f([G_n]_4, [G_{n-1}]_4) + a\cdot([G_n]_4, [G_{n-1}]_4)\cdot\frac{{}_4[G_n]}{16} - b\cdot([G_n]_4, [G_{n-1}]_4)\cdot\frac{{}_4[G_n]\rangle\rangle 3}{2} \quad \text{Equation 14}$$

where it is defined that $[G_n]_4$ represents that zeros are provided to all the LSB 4 bits of $G_n$, and $[G_{n-1}]_4$ represents that zeros are provided to all the LSB 4 bits of $G_{n-1}$, and ${}_4[G_n]$ represents that zeros are provided to all the MSB 4 bits of $G_n$, and the values a and b are positive integers, and ${}_4[G_n]>>3$ functions such that binary data of the computed ${}_4[G_n]_2$ are shifted in the right direction by 3 bits, and as a result, it functions as division by $2^3$.

Also in the case a high speed computation is difficult as the pixel frequency becomes higher according to the resolution, even the gray data $G_n$ of the present frame can be modified omitting some LSBs. In the case of modifying respective 6 bits of $G_n$ and $G_{n-1}$, the conversion is as follows.

$$G'_n = f([G_n]_4, [G_{n-1}]_4) + a \cdot ([G_n]_4, [G_{n-1}]_4) \cdot \frac{4[G_n]\rangle\rangle 2}{4} - b \cdot ([G_n]_4, [G_{n-1}]_4) \cdot \frac{4[G_n]\rangle\rangle 2}{4} \quad \text{Equation 15}$$

As described above, a gray lookup table of p bits is used, and in the case of modifying only q-bit Gn and r-bit Gn−1, it is as follows (q, r>p.)

$$G'_n = f([G_n]_{8-p}, [G_{n-1}]_{8-p}) + a \cdot ([G_n]_{8-p}, [G_{n-1}]_{8-p}) \cdot \frac{p[G_n]_{8-q}\rangle\rangle(8-q)}{2^{(q-p)}} - b \cdot ([G_n]_{8-p}, [G_{n-1}]_{8-p}) \cdot \frac{p[G_n]_{8-r}\rangle\rangle(8-r)}{2^{(r-p)}} \quad \text{Equation 16}$$

An operation of an LCD having a function of a moving picture modification will now be described.

As described above, in order to remove a lagging effect of moving pictures, image signals $G_n$ of a frame are modified compared to the image signals $G_{n-1}$ of a previous frame and using the equations 17 to 20.

$$G_n' = G_n, \text{if } G_n = G_{n-1} \quad \text{Equation 17}$$

$$G_n' > G_n, \text{if } G_n > G_{n-1} \quad \text{Equation 18}$$

$$G_n' < G_n, \text{if } G_n < G_{n-1} \quad \text{Equation 19}$$

$$G_n' - G_n \propto G_n - G_{n-1} \quad \text{Equation 20}$$

That is, when the image signals provided by the present frame are identical with that of the previous frame, no modification is executed as shown in Equation 17, and when the present gray signal (or gray voltage) becomes higher than the previous one, the modification circuit raises the present gray (or gray voltage) and outputs the same as shown in FIG. 18, and when the present gray signal (or gray voltage) becomes lower than the previous one, the modification circuit lowers the present gray (or gray voltage) and outputs the same as shown in FIG. 19. At this time, states of the modification are proportional to the difference between the present gray (or gray voltage) and the previous one as shown in the equation 20.

Via the above-described modification process, the response speed of the LCD panel becomes faster based on the following reasons.

First, desired voltage is supplied. That is, if a person wishes to supply 5V to liquid crystal cells, the actual 5V is supplied to the cells. When the liquid crystal reacts to the electric field and the direction of the director of the liquid crystal is changed, the capacitance is also changed, and accordingly, the voltage different from the previous one is supplied to the liquid crystal.

That is, even when the response speed of the liquid crystal is within one frame (16.7 ms, @60 Hz), the conventional AMLCD driving method does not provide accurate voltages according to the above-noted mechanism and but the voltage between the previous and present voltages, and accordingly, the actual response speed of the LCD panel is delayed more than the one frame.

The desired voltage is generated according to the signal modification and therefore correct response is performed. At this time, transmission errors during the response time of the liquid crystal can be compensated by performing an overcompensation.

Second, the response speed of the liquid crystal material generally becomes faster as the voltage is greatly varied. For example, in the case of rising, the response speed is faster when the voltage is switched from 1V to 3V than when the voltage is switched from 1V to 2V, and in the case of falling, the response speed is faster when the voltage is switched from 3V to 1V than when the voltage is switched from 3V to 2V.

This tendency is preserved in most cases even though there are some differences depending on the liquid crystal or the driving modes of the LCD. For example, in the case of the twisted nematic mode, the response speed of the rising becomes 15 times faster and that of the falling becomes 1.5 times faster as the voltage difference becomes greater.

Third, in the case the response speed of the liquid crystal is greater than one frame (16.7 ms), the response time can be lowered to one frame by using a forced traction method. It is assumed that there is a liquid crystal that has a response time of 30 ms when the voltage is changed from 1V to 2V. In other words, in order to obtain the transmission corresponding to 2V, 30 ms of time is needed when 2V voltage is supplied.

When it is assumed that a time for the identical liquid crystal to reach 3V from 1V is also 30 ms (in most cases, the time is shorter than this case), the transmission reaches its target transmission corresponding to 2V before 30 ms. That is, when supplying 3V in order to obtain desired transmission corresponding to 2V, the transmission reaches its target transmission corresponding to 2V in a time shorter than 30 ms.

When continuously supplying 3V, the liquid crystal reaches 3V, and accordingly, the access voltage is cut off when the voltage reaches 2V, and when 2V is supplied, the liquid crystal reaches 2V in a time shorter than 30 ms. A time to cut off the voltage, that is, to switch the voltage is when the frame is switched. Therefore, if the voltage of the liquid crystal reaches 2V after a single frame (16.7 ms), for example, 3V voltage is supplied and it becomes to 2V at a subsequent frame, the response time becomes 16.7 ms. In this case, the transmission errors during the response time (e.g., 16.7 ms) of the liquid crystal can be set off using the compensation method.

According to the above-noted embodiment of the present invention, as described above, the pixel voltage can reach the target voltage level by modifying the data voltage and supplying the modified data voltage to the pixels. Hence, the response speed of the liquid crystal can be improved without modification of the configuration of the TFT LCD panel.

Also, in the case of driving the LCD and particularly in the case of implementation of the moving pictures, the size of the gray lookup table of the image signal modification circuit for enhancing the response speed of the liquid crystal can be reduced and the quantization errors can be removed.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A liquid crystal display, comprising:

a pixel representing an image;

a data gray signal modifier receiving n-bit gray signals from a data gray signal source, and generating first modified gray signals based on m-bit gray signals of the present and previous frames among n-bit gray signals (n>m. n and m are integers), and outputting n-bit gray signals based on the first modified gray signals; and a data driver which generates corresponding data voltages based on the first modified gray signals and outputs image signals to the pixel.

2. The liquid crystal display of claim 1, wherein the m-bit gray signals are signals referencing orderly from a most significant bit among the n-bit gray signals.

3. The liquid crystal display of claim 2, wherein the first modified gray signals are equal to or greater than m-bit of the n-bit gray signals of the present frame, when the n-bit gray signals of the present frame are greater than n-bit gray signals of the previous frame.

4. The liquid crystal display of claim 3, wherein the first modified gray signals are equal to or smaller than m-bit of the n-bit gray signals of the present frame, when the n-bit gray signals of the present frame are smaller than n-bit gray signals of the previous frame.

5. The liquid crystal display of claim 2, wherein the first modified gray signals are equal to or smaller than m-bit of the n-bit gray signals of the present frame, when the n-bit gray signals of the present frame are smaller than n-bit gray signals of the previous frame.

6. The liquid crystal display of claim 1, wherein the first modified gray signals are equal to or greater than m-bit of the n-bit gray signals of the present frame, when the n-bit gray signals of the present frame are greater than n-bit gray signals of the previous frame.

7. The liquid crystal display of claim 6, wherein the first modified gray signals are equal to or smaller than m-bit of the n-bit gray signals of the present frame, when the n-bit gray signals of the present frame are smaller than n-bit gray signals of the previous frame.

8. The liquid crystal display of claim 1, wherein the first modified gray signals are equal to or smaller than m-bit of the n-bit gray signals of the present frame, when the n-bit gray signals of the present frame are smaller than n-bit gray signals of the previous frame.

9. The liquid crystal display of claim 1, the data gray signal modifier further comprising a look up table in which at least one of the first modified gray signals is stored.

10. A liquid crystal display, comprising:

a pixel representing an image;

a data gray signal modifier receiving n-bit gray signals from a data gray signal source, and generating first modified gray signals based on m-bit gray signals of the present and previous frames among n-bit gray signals and generating second modified gray signals adding (n-m)-bit gray signals of the n-bit gray signals to the first modified gray signals (n>m. n and m are integers); and a data driver which generates corresponding data voltages based on the second modified gray signals and outputs image signals to the pixel.

11. The liquid crystal display of claim 10, wherein the m-bit gray signals are signals referencing orderly from a most significant bit among the n-bit gray signals.

12. The liquid crystal display of claim 11, wherein the second modified gray signals are equal to or greater than n-bit gray signals of the present frame, when the n-bit gray signals of the present frame are greater than n-bit gray signals of the present frame.

13. The liquid crystal display of claim 12, wherein the second modified gray signals are equal to or smaller than n-bit gray signals of the present frame, when the n-bit gray signals of the present frame are smaller than n-bit gray signals of the previous frame.

14. The liquid crystal display of claim 11, wherein the second modified gray signals are equal to or smaller than n-bit gray signals of the present frame, when the n-bit gray signals of the present frame are smaller than n-bit gray signals of the previous frame.

15. The liquid crystal display of claim 10, wherein the second modified gray signals are equal to or greater than n-bit gray signals of the present frame, when the n-bit gray signals of the present frame are greater than n-bit gray signals of the present frame.

16. The liquid crystal display of claim 15, wherein the second modified gray signals are equal to or smaller than n-bit gray signals of the present frame, when the n-bit gray signals of the present frame are smaller than n-bit gray signals of the previous frame.

17. The liquid crystal display of claim 10, wherein the second modified gray signals are equal to or smaller than n-bit gray signals of the present frame, when the n-bit gray signals of the present frame are smaller than n-bit gray signals of the previous frame.

18. The liquid crystal display of claim 10, the data gray signal modifier further comprising a look up table in which at least one of the first modified gray signals is stored.

* * * * *